United States Patent [19]

Tetro et al.

[11] 4,111,377

[45] Sep. 5, 1978

[54] METHOD AND APPARATUS FOR CONTINUOUSLY WINDING A ROLL OF WEB MATERIAL

[75] Inventors: Richard S. Tetro; Paul E. Harmon, both of Fulton, N.Y.

[73] Assignee: The Black Clawson Company, Fulton, N.Y.

[21] Appl. No.: 799,153

[22] Filed: May 23, 1977

[51] Int. Cl.[2] ..... B65H 19/20

[52] U.S. Cl. ..... 242/56 R; 242/64; 242/65

[58] Field of Search ..... 242/54 R, 56 R, 56 A, 242/56.6, 67.1 R, 64, 65; 83/557, 175; 30/272 R, 272 A

[56] References Cited

U.S. PATENT DOCUMENTS

| | | | |
|---|---|---|---|
| 2,915,255 | 12/1959 | Phelps | 242/56 R |
| 3,756,526 | 9/1973 | Bassett | 242/56 R |
| 3,832,773 | 9/1974 | Langford | 30/272 A |
| 3,857,524 | 12/1974 | Melead | 242/56 R |
| 3,889,892 | 6/1975 | Melead | 242/65 |
| 3,974,723 | 8/1976 | Erdody | 83/175 |

*Primary Examiner*—Edward J. McCarthy
*Attorney, Agent, or Firm*—Biebel, French & Nauman

[57] ABSTRACT

A surface winder and roll changing mechanism includes primary arms rotatable through 360° between a substantially horizontal initial position where a new core can be loaded, a second position where the primary arms transfer the new core with the roll being formed thereon to secondary arms, and an intermediate position between the initial and second positions in which the web is cut and started on the new core, the primary arms being rotatable in one direction to return them to the initial position. In one embodiment, a grab knife is carried by the primary arms, and the web cutting knife is separately mounted on the frame, while in a second embodiment, both the grab knife and the cutting knife are carried by the primary arms. A single cutting knife or a reciprocating double cutting knife assembly may be used in either embodiment.

6 Claims, 16 Drawing Figures

METHOD AND APPARATUS FOR CONTINUOUSLY WINDING A ROLL OF WEB MATERIAL

BACKGROUND OF THE INVENTION

1. Field of the Invention

The present invention relates to continuous winders for web materials, and more particularly, to surface winders of the type having primary and secondary arms for transferring a core and roll of material being formed from one position to another.

Prior Art

Continuous winders generally similar to the present invention are disclosed, for example, in U.S. Pat. Nos. 3,974,723 and 3,794,255. These devices are surface winders with primary and secondary arms which incorporate roll change mechanism to provide for transfer of the winding web from the roll in the secondary arms to the new core in the primary arms in such manner that the winding is continuous.

The primary arms are the arms on which a new core is first positioned prior to the web being wound on that core and during the first portion of the winding of each new roll. The secondary arms are the arms which support the core during the majority of the winding operation, after the core has been transferred thereto from the primary arms. Once a roll has been substantially fully formed on the secondary arms, a core supported by the primary arms, and having an adhesive surface, is brought into contact with the web supported on a drive drum. This surface to surface contact provides the drive means for forming a roll.

At the time of transfer of the web from the completed roll to the new core, the web is severed downstream of the new core so that the web will immediately begin to wind around the new core due to the adhesive contact therewith and will continue to form the new roll. After the previously formed roll has been removed from the secondary arms, the primary arms are rotated in a concentric path around the driving drum so that the new roll maintains driven engagement with the web on the surface of the drive drum. Once the new roll has been rotated to the position of the secondary arms, it is transferred to the secondary arms and the primary arms are rotated in the opposite direction back to their initial position for receiving another new core.

The web cutting mechanism can take a variety of forms such as those disclosed in the above referred to patents. A common attribute of such devices is in the use of a shoe or anvil member mounted for rotation concentric with the drive drum from a position out of contact with the web to a position which supports the web off of the surface of the drive drum at a location where the cutting knife will sever the web. These mechanisms are rotated to and from their operating position by a simple sprocket and chain drive mechanism under the control of an operator of the winder.

Thus in such prior art devices, the mechanisms for movement of the primary arms and of the shoe or anvil and cutting mechanism are, and must be, actuated independently to accomplish their individual tasks. This not only requires duplication of mechanisms, but also requires several operator functions and understanding of the proper sequence or complex automatic controls in order to operate the winder correctly.

SUMMARY OF THE INVENTION

The present invention overcomes the above described disadvantages and difficulties associated with prior art devices by providing primary arms rotatable continuously in one direction through 360°, and which can accomodate the shoe or anvil to be positioned under the web during the cutting and transfer of the web to a new core. This construction reduces the mechanisms required to operate the primary arms and cutting mechanism of the winder and reduces the complexity of operation to make the operator's task more simple.

The present invention, like the prior art devices previously referred to, utilizes primary and secondary roll support arms and a driven drum supported in a frame structure so that the web of the material to be wound passes in driven engagement over an arcuate portion of the surface of the drum. The core and roll being wound thereon, whether they are supported by the primary or secondary arms, are maintained in contact with the web supported by the surface of the drum so as to drive the core and roll in order to wind the web material onto the roll.

The primary arms are disposable in a horizontal position for initial loading of a new core onto it. The core is initially placed on the primary arms in a position spaced from the surface of the drum in a ready position where it can be easily engaged with the surface of the drum by the machine operator.

The secondary arms are likewise spaced at opposite ends of the drive drum, but not necessarily positioned for concentric rotation about the drive drum as are the primary arms. The secondary arms need merely have an arcuate path which intersects that of the movement of the core on the primary arms, so that when the primary arms are rotated to the position for transfer to the secondary arms, the secondary arms can be brought into position to accept the core and roll being formed thereon.

Both the primary and secondary arms are provided with core support mechanisms which permit the center of the roll being worked to move radially outwardly from the center of the drive drum as the roll picks up thicknesses of the web being wound thereon.

A web cutting position is provided intermediate the initial core loading position and a secondary position where the core is transferred to the secondary arms. A web cutting mechanism is provided, supported either by the primary arms or by the machine frame structure, for severing the web material downstream of the position of the new core on the primary arms so that when the web is severed, it will immediately begin to wind itself about the new core.

The invention also provides means for supporting a short length of the web in spaced relation with the drum in cooperation with the knife mechanism for effecting the cutting and transfer of the web to a new core. Where the cutting mechanism is supported by the machine frame structure, this supporting mechanism includes guide means such as guide rolls and/or an anvil supported by the primary arms for concentric rotation about the drum just above the surface of the drum so that it may be rotated into registry with the cutting mechanism, but on the opposite side of the web therefrom.

In an alternative case, when the cutting mechanism is of the type for example disclosed in U.S. Pat. No. 3,974,723, it is possible to have the entire cutting mechanism supported by the primary arms for concentric rotation about the drum in a manner similar to the anvil or shoe above described.

Although both of the types of cutting mechanisms described above are broadly in the prior art, the present invention provides distinct advantages over these mechanisms in that either the guide means or the completely self-contained cutting mechanisms are mounted on the primary arms for movement therewith at a fixed angular displacement relative to the position of the core such that the web will be severed downstream of the position of the new core being brought into contact with the surface of the web on the drum. This eliminates the necessity for the duplicate mechanism utilized in the prior art to rotate the anvil or separate cutting mechanism and the primary arms independently, and thereby makes it possible and practical to rotate the primary arms through a complete 360° without interfering with any other part of the winder.

A grab knife assembly as disclosed in U.S. Pat. No. 3,974,723 can also be utilized in the present invention, secured to the primary arms for rotation therewith along with the cutting mechanisms, where the cutting mechanism is also secured to the primary arms for rotation therewith.

In addition, the present invention provides a web cutting mechanism for use in the winders disclosed herein which includes a pair of saw tooth type blades operative for relative lateral movement to produce a shearing action in the web material as the cutting teeth on one blade move laterally sidewise relative to the other blade to produce a scissor-type action which shears the material. This cutting mechanism is particularly useful where the web is composed of a fibrous material in which the fibers are relatively long and would otherwise not completely sever with the use of conventional cutting mechanisms.

DETAILED DESCRIPTIONS OF THE PREFERRED EMBODIMENTS

Figure 1:
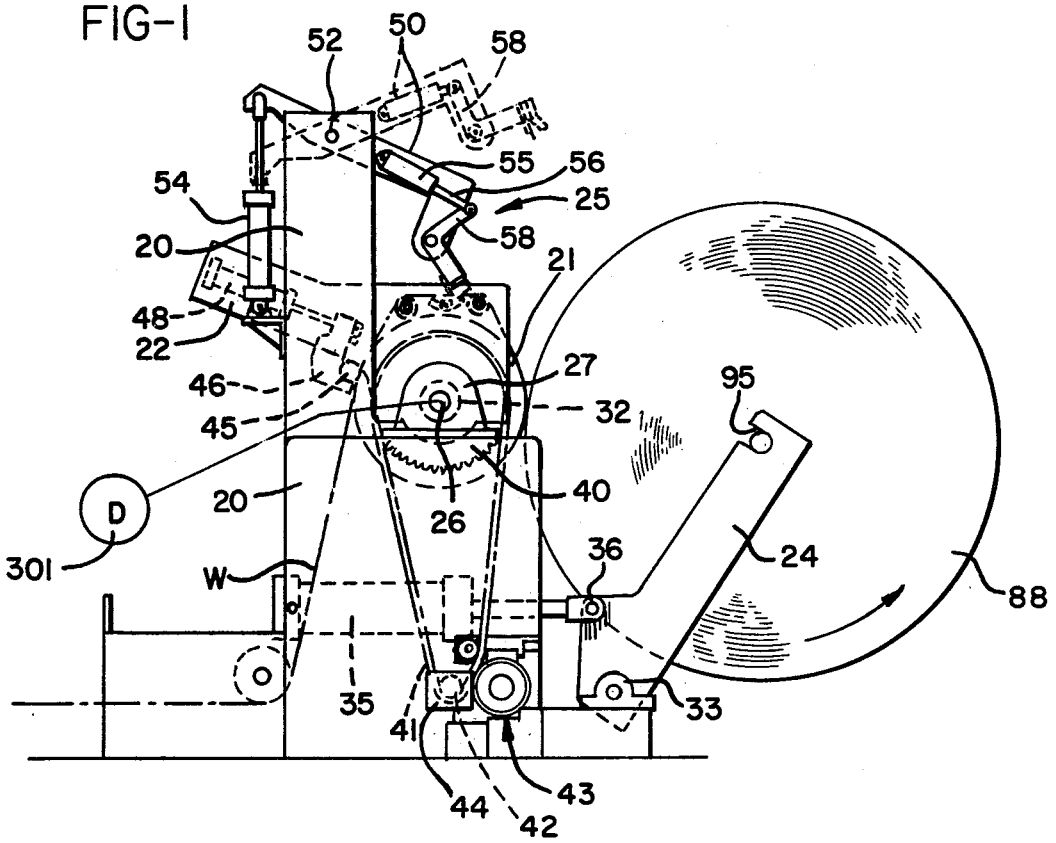
FIG. 1 is a diagrammatic view in side elevation of a preferred embodiment of a continuous winder constructed in accordance with the present invention.

The winder illustrated in FIG. 1 basically comprises an overall frame structure 20 supporting a drive drum 21, primary and secondary arms 22 and 24 respectively (only one of each being seen in FIG. 1), and a web cutting mechanism 25. The drive drum 21 has a smooth cylindrical surface for engaging the web W across its entire width and is driven through a central drive shaft 26 which is supported at each end for rotation in bearing blocks 27 secured to the frame 20 and is driven by any suitable constant speed drive means 30.

The two primary arms 22 are disposed at opposite ends of the drive drum 21 in fixed registry with each other on a sleeve 32 for simultaneous rotation concentric with the central shaft 26 but independently of rotation of the drive drum 21, their movement normally being clockwise as viewed in FIG. 1. The secondary arms 24 are each pivotally mounted on the frame structure 20 by a bearing assembly 33. A double acting fluid pressure cylinder 35 is operably connected at 36 to a central portion of each of the secondary arms. The secondary arms 24 are located outwardly of the primary arms 22 so that the primary arms can rotate through a full 360° without interference.

The indexing drive for the primary arms 22 includes a driven sprocket 40 which is operatively connected to the sleeve 32 and driven through a chain 41 and drive sprocket on shaft 42 by a drive indicated generally at 43. The drive 43 may be manually controlled by the operator of the machine, but ordinarily it will be provided with the usual limit switch control 44 coupled with the shaft 42 and effective to position the primary arms 22 properly at each of its successive positions in a complete cycle of rolls starting and changing. For example, the switch 44 may be a rotating cam switch of the type sold by Gemco Electric Company which can be connected to control all functions of the winder in the proper sequence.

Figure 5:
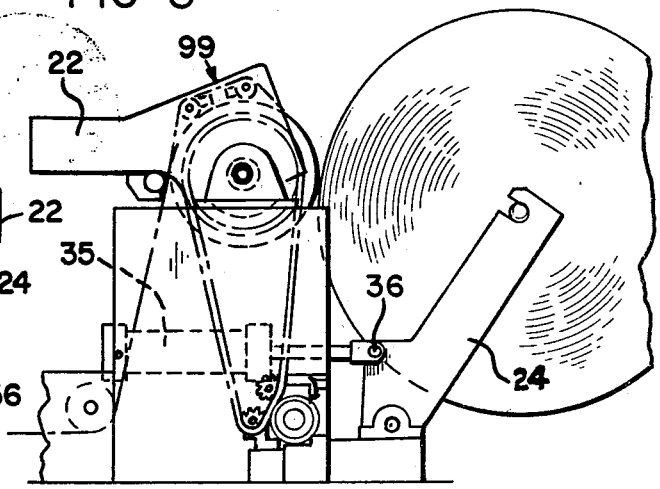
FIG. 5 is a diagrammatic view in side elevation showing a second embodiment of continuous winder constructed in accordance with the present invention.

The primary arms 22 are illustrated in FIG. 1 in their roll changing position with a new core 45 supported in contact with the web on the drum. The mechanism supported by each primary arm for holding the new core is on the trailing side of the arm and includes an L-shaped bracket 46 movable on the arm radially with respect to the central shaft 26. In the core loading position, wherein the arms 22 are substantially horizontal as shown in FIG. 5, the brackets 46 clamp the new core shaft against a stationary cam (not shown) on the frames which thereby holds the new core spaced from the drum surface.

Movement of brackets 46 is controlled by double acting fluid pressure cylinders 48 which are secured to each of the primary arms 22 for rotation therewith. Movement of the new core 45 into contact with the web is effected by rotation of the primary arms, which causes the core shaft to follow the cam profile until the core is brought against the web traveling on the drum 21. Preferably the arms 22 are held in an initial position, wherein the new core is loaded in the brackets 46, which is essentially horizontal.

Figure 2:
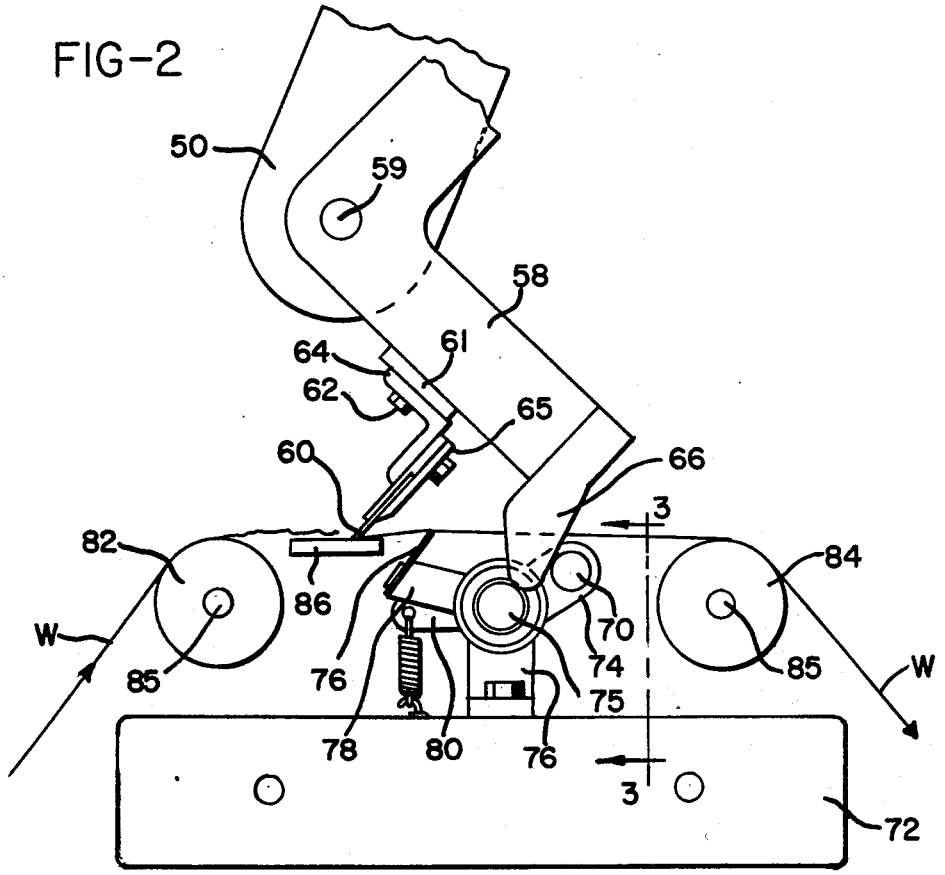
FIG. 2 is an enlarged view of a fragment of FIG. 1, showing details of the web cutting mechanism.
Figure 3:
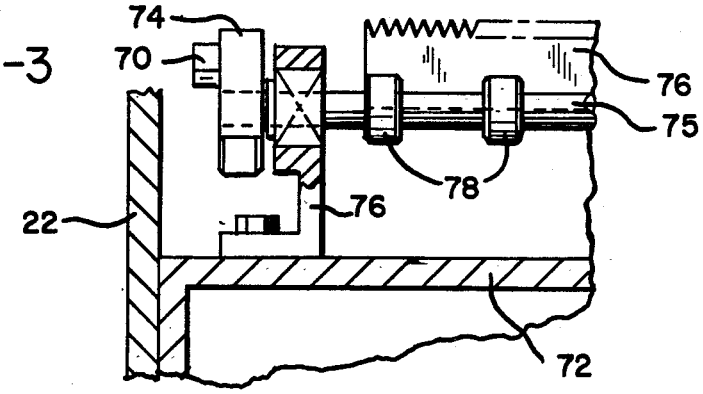
FIG. 3 is a fragmentary section generally on the line 3—3 of FIG. 2.

Cutting of the web by the web cutting mechanism 25, which is shown in detail in FIG. 2, is also timed by the limit switch 44 to occur where the new core contacts the web on the drum surface. Lever arms 50 support the cutting mechanism 25 and are pivotally mounted at their central portions at 52 on the frame structure 20. At the end of one or both of lever arms 50 opposite the end carrying the web cutting mechanism 25 is a double acting fluid pressure cylinder 54 having its other end operably connected to the frame structure 20 for rotating lever arms 50 between their cutting position shown in full lines in FIG. 1 and their rest position shown in broken lines in FIG. 1 wherein the cutting mechanism is above the path of primary arms 22 and a winding roll supported thereby.

When the lever arms 50 are rotated by cylinder 54 into the cutting position, the cutting mechanism is actuated by a similar cylinder 55 secured to one lever arm 50 and having its piston rod 56 operably connected to one arm of the adjacent double-armed lever 58, which in turn is pivotally mounted at 59 on each lever arm 50. Secured to the opposite arms of levers 58, as can best be seen in FIG. 2, is the actual cutting blade 60 which is removably mounted on lever arms 58 by means of a cross bar 61, bolts 62, an angle 64, and a pair of blade support plates 65. Cutting blade 60 extends entirely across the web surface between the primary arms 22 so as to sever the web completely as it swings along the arcuate path defined by the radius from its edge to the pivot axis 59.

Also, secured to the same end of one lever arm 58 as cutting blade 60 is a camming member 66 disposed outside the width of the drive drum 21 so that it can extend radially inward toward central shaft 26 beyond the surface of the web W, to come into contact with the cam follower 70 which is a part of the grab knife assembly carried by a mounting bracket 72 secured at its opposite ends to the primary arms 22.

The cam follower 70 is carried by a lever arm 74 which is in turn secured to a shaft 75 extending across the width of the machine and rotatably mounted at its ends in brackets 76 secured on mounting bracket 72. A grab knife 76 of the type disclosed in U.S. Pat. No. 3,974,723 is carried by arms 78 secured on shaft 75 for rotation therewith, so that upon movement of the cam follower 70 along the camming surface of camming member 66, the grab knife 76 will be rotated upwardly into seizing engagement with the web W downstream from the path of cutting knife 60 into the web.

A further lever arm 80 is secured to shaft 75 angularly opposite lever arm 74. A spring 81 is secured at one end to the outer end of lever arm 80 and has its opposite end secured to the grab knife assembly mounting bracket 72, to bias the cutting mechanism to its retracted position out of contact with the web W until the camming member 66 engages cam follower 70 and overrides the spring force.

Two guide rolls 82 and 84 are mounted on shafts 85 extending between the primary arms 22 and serve to support the web during the web cutting operation. A web support plate 86 also extends between the primary arms 22 beneath the surface of web W in alignment with cutting knife 60, so that when the cutting knife contacts the web, the web support plate 86 acts as a backing member or anvil to support the web while the knife blade severs it.

Referring again to FIG. 1, after the web has been severed by action of the web cutting mechanism 25, the web W will begin to wind around new core 45, since the new core is conventionally provided with an adhesive surface. The cutting mechanism 25 is then retracted to the position illustrated in dotted lines in FIG. 1, and after the previously completed roll 88 has been removed from the secondary arms 24, the primary arms 22 are rotated to the position illustrated in FIG. 4.

Figure 4:
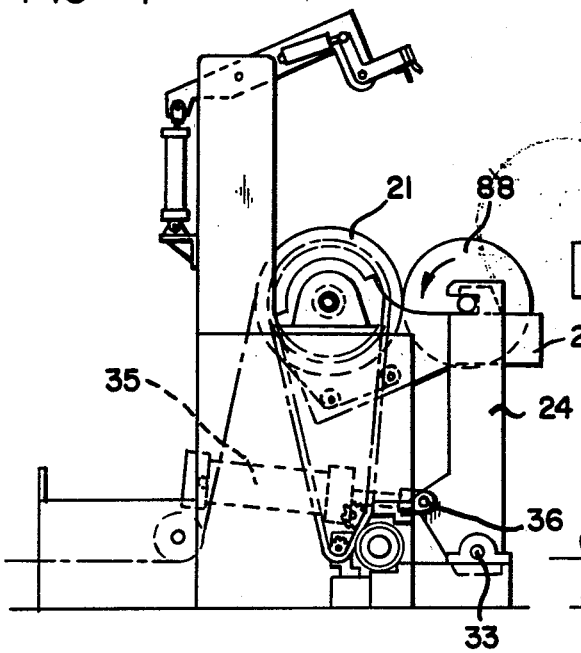
FIG. 4 is a diagrammatic side view of the embodiment of FIG. 1 with the primary arms in position to transfer the core and roll to the secondary arms.

During rotation from the initial position illustrated in FIG. 1 to the position illustrated in FIG. 4, the new core 45 and roll being wound thereon are in constant contact with the surface of drive drum 21 so that the new roll is continuously being wound while it is rotated. The pressure cylinders 48 which operate brackets 46 in the manner previously described maintain contact between the new roll and web on the surface of drum 21 by maintaining a radially inward pressure on the new roll which is constantly increasing in diameter during winding.

The outer end of each secondary arm 24 has a slot 95 for receiving one end of the core 45, and for roll transfer purposes, the primary arms 22 are rotated to the position illustrated in FIG. 4 wherein the secondary arms 24 can be moved into the position illustrated in which the core 45 is received in the slots 95. The pressure cylinders 35 operate to bring the secondary arms 24 into the position illustrated in FIG. 4 after a previously wound roll 88 has been removed and the new roll is in position for transfer, maintaining contact between the surface of the roll being formed and the web on the surface of the drum 21 as the diameter of the roll increases.

Transfer of the core 45 from the primary arms 22 to the secondary arms 24 is accomplished in the position shown in FIG. 4 by activating the cylinders 48 to move brackets 46 radially outward until they are free of the core and the core is supported in the slots 95 in the secondary arms 24, which have been rotated counterclockwise to the position shown, by fluid cylinder 35. The primary arms 22 can then be continued in their clockwise rotation back to the initial horizontal position for the loading of a new core 45, during which movement, the guide rolls 82 and 84 move under the web W and support a length thereof above drum 21 between the new core 45 and the nip formed by the winding roll 88 against the drum, as shown in FIG. 1.

A second embodiment of the present invention is illustrated in FIGS. 5–9 and is constructed in essentially the same manner as the above described embodiment, with the exception that the web cutting mechanism is supported entirely by the primary arms 22, thus eliminating the upper frame portion of the embodiment illustrated in FIG. 1 which supports the lever arms 50 and cutting mechanism 25. The basic construction of this second embodiment is essentially the same as that described in connection with the first embodiment, with the exceptions noted below; therefore the details of the similar portions of construction will not be repeated; and the same reference characters are used for parts which are the same in both embodiments.

Figure 10:
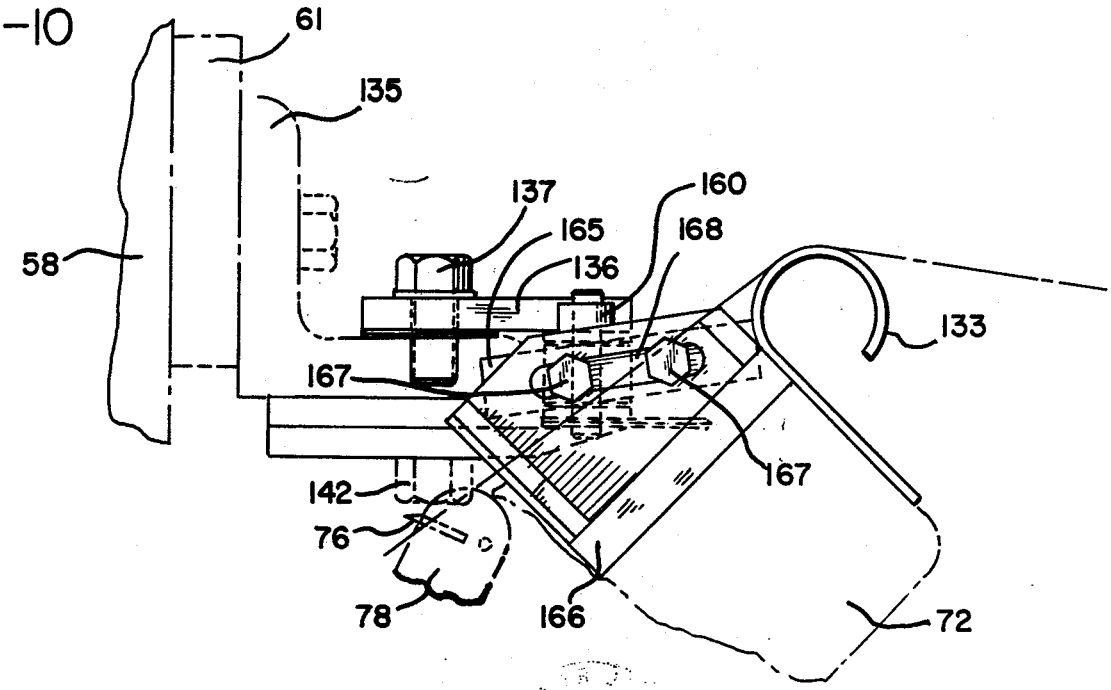
FIG. 10 is a fragmentary side view showing an alternative cutting mechanism which can be utilized in the embodiment of either of FIGS. 1 and 5.
Figure 11:
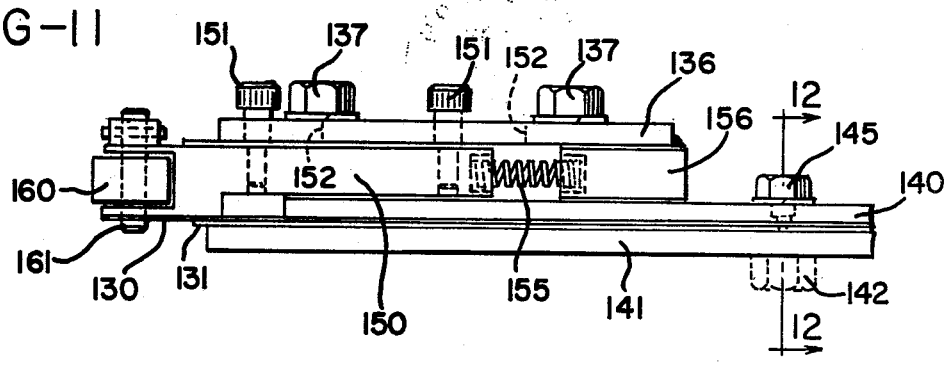
FIG. 11 is a fragmentary elevation looking from right to left in FIG. 10.
Figure 12:
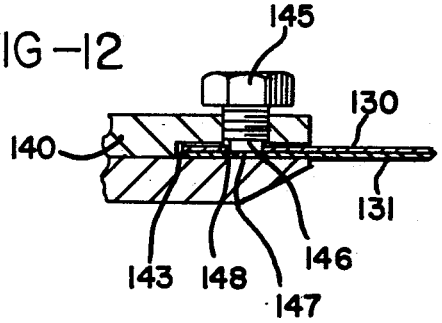
FIG. 12 is a fragmentary section on the line 12—12 of FIG. 11.
Figure 13:
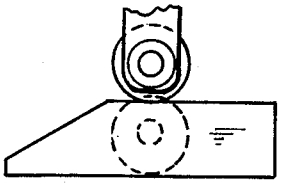
FIG. 13 is a fragmentary view looking downwardly in FIG. 11.

The cutting mechanism utilized in the second embodiment is basically of the type disclosed in FIGS. 10–12 of U.S. Pat. No. 3,974,723. It is designated generally as 99 in FIGS. 5 and 8, and is illustrated in detail in FIGS. 6 and 7. A pair of shafts 100 and 101 corresponding to the shafts 85 extend between the primary arms 22 and have guide rolls 102 and 103 freely rotatable thereon. A web cutting knife 105 is supported on shaft 100 by arms 106 and extends across the full width of the web W for cutting movement along the arcuate path defined by the radius from its edge to the axis of shaft 100. A grab knife 110 is similarly supported by arms 111 on the shaft 101 and also extends across the width of the web W for movement into seizing engagement with the web downstream from the path of cutting knife 110.

Figure 7:
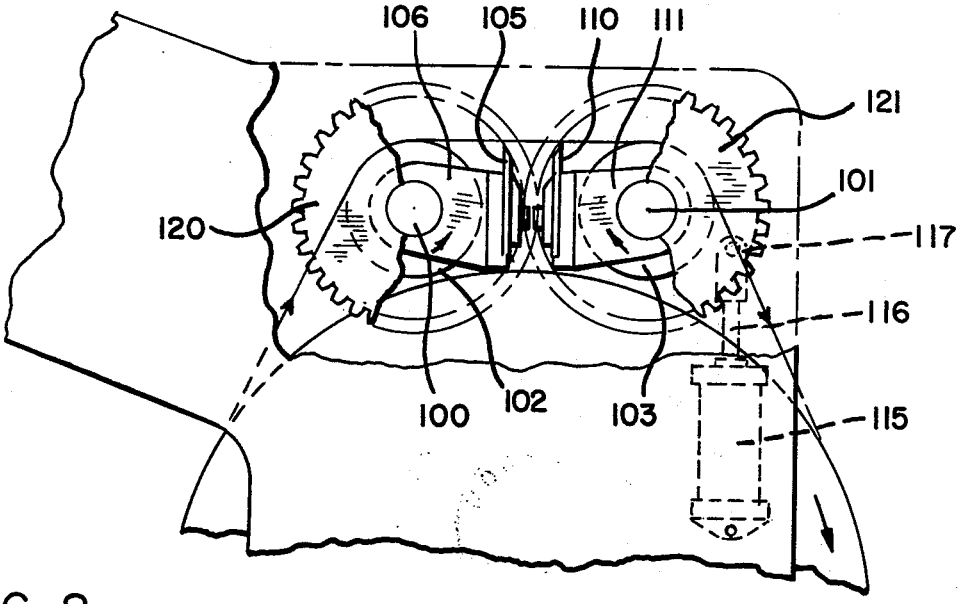
FIG. 7 is an enlarged fragment of FIG. 6 showing details of the cutting mechanism.
Figure 8:
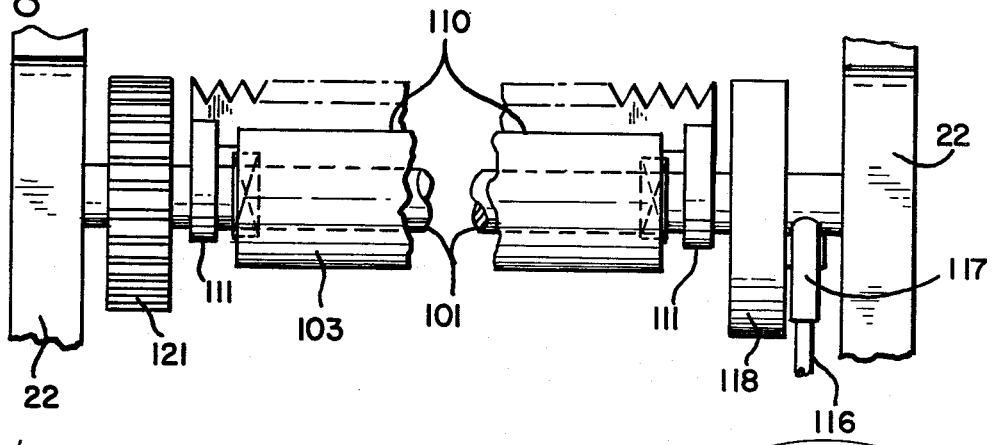
FIG. 8 is a fragmentary view looking from right to left in FIG. 7.

On one side of the machine, a fluid pressure cylinder assembly 115 is secured to the adjacent primary arm 22, and its piston rod 116 is operably connected to an eccentric pin 117 on a collar 118 secured to shaft 101 for rotation therewith. Upon activation of the cylinder assembly 115, collar 118 is rotated clockwise as illustrated in FIG. 7 so as to cause grab knife 110 to engage the web W. The grab knife 110 is generally disposed in a rest position which will not engage the web W, and is maintained in that position by the cylinder assembly 115.

On the opposite side of the machine from the cylinder assembly 115 are a pair of meshing gears 120 and 121 secured to shafts 100 and 101, respectively, for rotation therewith. Therefore, as the cylinder assembly 115 is activated, the motion is transmitted to shaft 100 via gears 120 and 121 so that the web cutting knife 105 will be rotated counterclockwise as viewed in FIG. 7 when grab knife 110 is rotated clockwise. This will cause the web cutting knife 105 to engage and sever the web W simultaneously with action of the grab knife 110 upon activation of the cylinder assembly 115.

Figure 6:
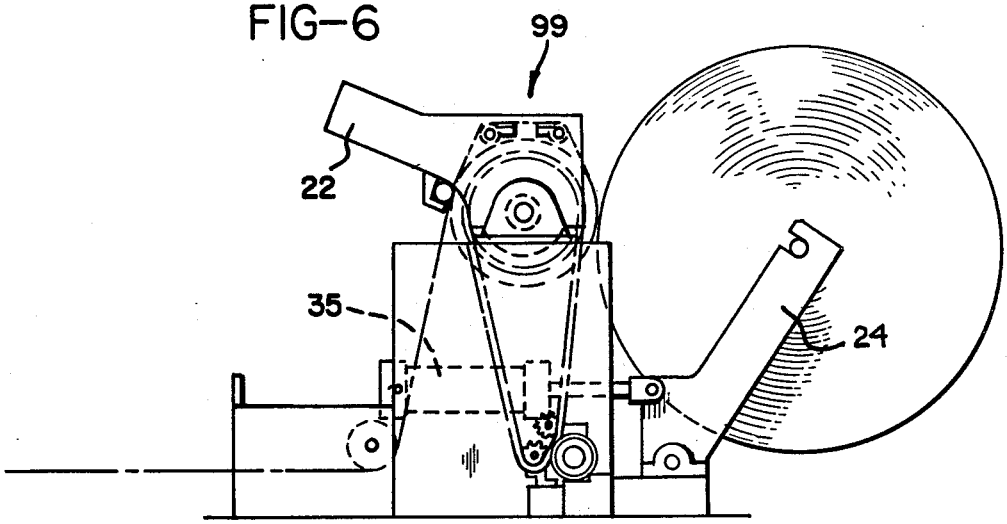
FIG. 6 is a view similar to FIG. 5 with the primary arms located in the web cutting position.

FIG. 5 shows the primary arms 22 in their essentially horizontal initial position wherein a new core can be inserted in the same manner described as to FIG. 1. FIG. 6 illustrates the primary arms 22 rotated to the roll changing position in which the cutting knife 105 and grab knife 110 can be activated to cut the web as illustrated in FIG. 7. Once the web W has been severed, the previously formed roll 88 can be removed from the secondary arms 24, which are mounted and activated in the same manner as in the first embodiment.

Figure 9:
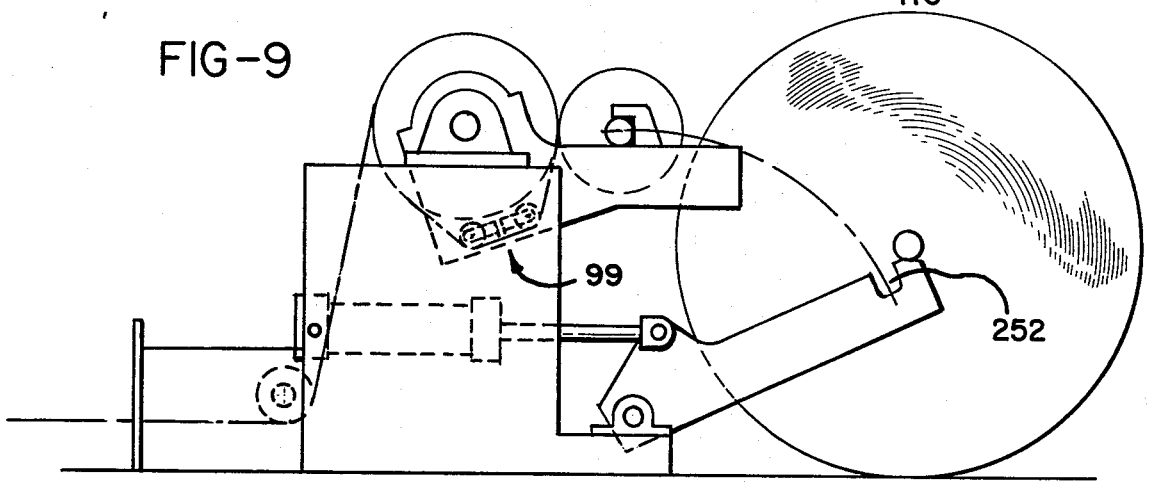
FIG. 9 is a diagrammatic side view of the embodiment of FIG. 5 with the primary arms located for transfer of the roll and core to the secondary arms.

The primary arms 22 are moved into the transfer position as illustrated in FIG. 9, and the secondary arms 24 are then rotated counterclockwise as illustrated in FIG. 9 with the slots 95 at the end of each secondary arm in alignment with the axis of the new core and the roll being wound so that transfer may be effected as described with the first embodiment. The primary arms 22 can then continue to rotate after transfer of the new core, so as to be brought back into the initial position illustrated in FIG. 5, for introduction of a new core. With either cutting mechanism, the positions of the primary arms at and immediately after roll changing should be such as to assure adequate maintained driving engagement of the newly started roll with the drum 21 through the web.

In both of the above described embodiments, the primary arms will rotate through 360° and need not reverse their rotational direction during the sequence of movements from the initial position in which a new core is mounted thereon, through a secondary position in which the new core and roll being wound thereon are transferred to the secondary arms, and back to the initial position for loading with a new core.

In both embodiments, the cutting of the web takes place at a position intermediate the initial core loading position and the roll transfer position to the secondary arm. In the second embodiment, the position of the primary arms when the web cutting operation takes place is not necessarily important, and the actual position will be dictated by construction of the machine. In both embodiments, the knife cut should occur when the new core makes contact with the web.

It is preferable for the present invention to have the new core loading position in a generally horizontal plane approximately 180° opposed to the transfer position, since this promotes easy loading of the core by an operator. Obviously, the cutting position must be somewhere intermediate the initial new core loading position and the transfer position, in order to sever the web and have the web begin winding on the new core.

Both the web cutting knives and grab knives described in connection with the above embodiments are essentially constructed in accordance with the teachings of U.S. Pat. No. 3,974,723, and each is a single blade having a serrated or saw tooth cutting edge, with the grab knife edge being designed to grip the material rather than cut it while the knife assembly is designed for actually severing the web.

As an alternative construction to these forms of cutting knives, a novel cutting means is shown in FIGS. 10–15 which is particularly useful when cutting webs of extremely fibrous material. Webs of such material otherwise tend to gather at the bottom of the teeth rather than being cut when utilizing the above referred to prior art cutting knives and grab knives.

Figure 14:
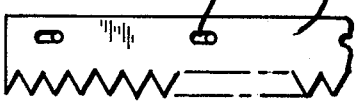
FIGS. 14–16 are schematic illustrations of the changes in position of the cutting blades illustrated in FIG. 10 during cutting of the web.
Figure 15:
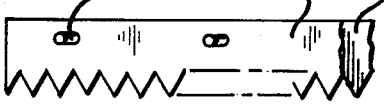
Figure 16:
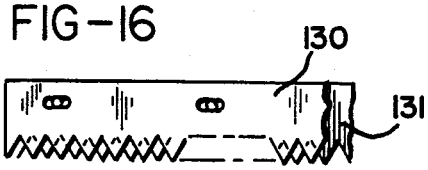

Either of the above described embodiments can be easily adapted to utilize the cutting blade mechanism illustrated in FIGS. 10–16, which basically comprises a pair of serrated edge cutting blades 130 and 131 mounted for lateral movement relative to one another so as to produce a shearing action in the material of the web. FIGS. 14–16 illustrate the sequence in change of position of the blades during the cutting operation.

The view in FIG. 10 is from the opposite side of the machine as compared with FIGS. 1 and 2, so that the web is traveling counterclockwise, but otherwise the grab knife assembly is the same, and the main components are identified by the same reference characters as in FIG. 2. Preferably a web deflector 133 is mounted on the leading end of the grab knife mounting bracket 72 in place of the guide roll 84 to provide an unsupported run of web where the cutting action of blades 130 and 131 takes place.

The angle 135 corresponds to the angle 64 in FIG. 2 and illustrates how the knife assembly of FIGS. 11–15 may be mounted on the lever arms 58. Referring to FIG. 10, the main supporting bracket 136 for the knife assembly is mounted on the angle 135 by a series of cap screws 137. In addition, upper and lower knife holders 140 and 141 are clamped to the underside of angle 135 by cap screws 142. The upper knife holder 140 is undercut along its outer end to provide a slot 143 in which the blades 130 and 131 are mounted as now described.

Multiple screws 145 are threaded through complementary tapped holes in the knife holder 140, and the end of each of these screws comprises a smooth shank portion 146 and a smaller pilot portion 147. The shank portion 146 of each screw 145 extends through a slot 148 in the top blade 130, while the pilot portion 147 is received in a mating hole in the bottom blade 131. With this arrangement, the bottom blade 131 is clamped to the bottom knife holder 141, while the upper blade 130 is free to reciprocate longitudinally to the extent permitted by the slots 148.

A sliding bracket 150 is supported for reciprocation in a clearance provided between the bracket 136 and the upper knife holder 140. Cap screws 151 extend through slots 152 in bracket 136 and are threaded into the bracket 150 to support it for guided sliding movement with respect to the bracket 136. A compression spring 155 is positioned between the inner end of the sliding bracket 150 and an overhanging portion 156 of bracket 136 to bias the sliding bracket 150 normally to the left as viewed in FIG. 10.

The opposite end of sliding bracket 150 from spring 155 is formed as a clevis to receive a cam follower roller 160 on a pivot pin 161 which also extends through a mating hole in the adjacent end of the upper knife blade 130. A cam 165 of the appropriate size and shape is mounted by a bracket 166 on the grab knife assembly mounting bracket 72, in such position that when the cutting knife assembly is moved to cutting position by its lever arms 58, the follower roller 160 will at the proper instant engage the cam 165 and be forced thereby to move the sliding bracket 150 and the upper knife 130 lengthwise against spring 155 and thereby to cause knife 130 to execute a shearing stroke with respect to the lower knife 131. The mounting screws 167 for cam 165 extend through a slot 168 in bracket 166 which provides for appropriate adjustment of cam 165.

The cutting knife assembly of FIGS. 10–15 is equally adaptable to use with the embodiment of the invention shown in FIGS. 5–9 by mounting the entire assembly directly on the shaft 100, and by mounting the cam 165 in an appropriate location on the appropriate primary arm 22. Since the cutting knives move about a shorter arc in this form of the invention, the cam 165 may need corresponding redesign, as will be readily apparent to one skilled in the art. Otherwise, the arrangement and operation of this cutting mechanism will be the same in both embodiments of the winder of the invention.

While the forms of apparatus herein described constitute preferred embodiments of the invention, it is to be understood that the invention is not limited to these precise forms of apparatus, and that changes may be made therein without departing from the scope of the invention.

What is claimed is:

1. In a continuous winder for web material including a frame, a driven drum supported in the frame for driving a roll of web material being wound, primary support means for supporting a core upon which a roll of web material is to be wound while the web is initially wrapped on the core, and secondary support means for accepting the core and winding roll from said primary support means and for supporting said core and roll during completion of the winding of the roll with the surface of the roll in driven engagement with the surface of the drum, the combination of:

(a) means mounting said primary support means for rotation on said frame in one direction through 360° about an axis concentric with the axis of rotation of the drum from an initial position wherein a core is mounted on said primary support means out of contact with the surface of the drum, through an intermediate position wherein said core is in contact with the web against the drum to a second position wherein said core is transferred to said secondary support means, and continuing rotation in the same direction to said initial position for acceptance of a new core, (b) cutting means supported by the frame and operable with said primary support arms in said intermediate position to cut the web from a full roll for transfer to a core supported by said primary support means, (c) guide means carried by said primary support means and effective in said intermediate position of said primary support means to support a length of the web out of engagement with the drum for cutting by said cutting means without contact with the drum, and (d) means for causing movement of said cutting means along a predetermined path into engagement with said supported length of the web.

2. A continuous winder as defined in claim 1 wherein said initial position of said primary support means is a generally horizontal position on the opposite side of the drum from said second position.

3. A continuous winder as defined in claim 1 wherein said cutting means are mounted on said frame separately from said primary support means for cutting movement along said path toward said length of the web and the drum.

4. A continuous winder as defined in claim 1 wherein said cutting means are mounted on said primary support means for cutting movement along said path toward said length of the web away from the drum.

5. A continuous winder as defined in claim 1 wherein said cutting means comprise a pair of knives supported for relative cutting movement laterally of the web, and further comprising means responsive to said movement of said cutting means along said predetermined path for causing said relative cutting movement of said knives.

6. A continuous winder as defined in claim 1 further comprising means carried by said primary support means in conjunction with said guide means for seizing said length of the web downstream from said path of said cutting means.

* * * * *